US010262633B2

(12) United States Patent
Powers

(10) Patent No.: US 10,262,633 B2
(45) Date of Patent: Apr. 16, 2019

(54) STRING INSTRUMENT HAVING UNITARY NECK SUPPORT AND FINGERBOARD BRACE

(71) Applicant: TAYLOR-LISTUG, INC., El Cajon, CA (US)

(72) Inventor: Andrew Taylor Powers, Carlsbad, CA (US)

(73) Assignee: TAYLOR-LISTUG, INC., El Cajon, CA (US)

( * ) Notice: Subject to any disclaimer, the term of this patent is extended or adjusted under 35 U.S.C. 154(b) by 0 days.

(21) Appl. No.: 15/626,432

(22) Filed: Jun. 19, 2017

(65) Prior Publication Data

US 2018/0366094 A1 Dec. 20, 2018

(51) Int. Cl.
*G10D 1/08* (2006.01)
*G10D 3/06* (2006.01)

(52) U.S. Cl.
CPC ..... *G10D 1/08* (2013.01); *G10D 3/06* (2013.01)

(58) Field of Classification Search
CPC ..... G10D 3/06
See application file for complete search history.

(56) References Cited

U.S. PATENT DOCUMENTS 5,353,672 A * 10/1994 Stewart ..... G10D 3/06 84/267
6,051,766 A * 4/2000 Taylor ..... G10D 3/06 84/267
2007/0277664 A1* 12/2007 Kroeger ..... G10D 3/02 84/291

FOREIGN PATENT DOCUMENTS

WO 00/74032 A1 12/2000

OTHER PUBLICATIONS

Fretsireland Custom Instruments; XP 055522530; dated Jan. 1, 2015; 14 total pages.
Extended European Search Report for Application No. 18177268.2; dated Nov. 19, 2018; 8 total pages.

* cited by examiner

*Primary Examiner* — Kimberly Lockett
(74) *Attorney, Agent, or Firm* — Patterson & Sheridan LLP

(57) ABSTRACT

Embodiments of the present disclosure relates to a string instrument, such as a guitar, having a neck support-fingerboard brace unit. The neck support-fingerboard brace unit is formed as a unitary unit or formed by fixedly attaching a neck support to a fingerboard brace before attaching the fingerboard brace to a guitar top. The solid connection between the neck support and the fingerboard brace allows the fingerboard brace, which rests on a guitar side, to provide support to the guitar neck, thus, reducing deformation in the guitar neck and the fret board.

21 Claims, 11 Drawing Sheets

STRING INSTRUMENT HAVING UNITARY NECK SUPPORT AND FINGERBOARD BRACE

BACKGROUND

Field

Embodiments of the present disclosure generally relate to configuration and construction of a string instrument. More particularly, the disclosure relates to a string instrument having a unitary neck support and fingerboard brace and methods for making the string instrument.

Description of the Related Art

A guitar typically has two main components, a neck and a body. The musician squeezes the strings of the guitar against frets that are on the neck in order to change pitch of the strings.

The way a guitar neck is connected to a guitar's body has remained basically unchanged for nearly a century. As shown in FIG. 1, a guitar 100 has a neck 102 attached to a body 104. The neck 102 is formed with a heel 106. The heel 106 that is glued or bolted to an outer surface of a guitar side 108 of the body 104. When bolted, one or more bolts running parallel to the length of the neck 102 can be used. As an alternative to simply resting against the outer surface of the guitar side 108, a portion of the heel 106 can be received into a mortice in the body 102. In such a configuration, the heel and mortice can be dovetailed such that the neck cannot move in a forward-backward direction illustrated by double-headed arrow 110.

A fretboard 112 having a flat underside is glued to a flat upper surface of the neck 102. The fretboard 112 typically offers 20 frets between a nut 114 at the far end of the neck 102. The twentieth fret 116 is closest to the center of the body 104. The location 118 where the heel 106 meets the body 104 is typically the fourteenth fret. In guitars with a shorter neck 102, the location 118 the heel 106 meets the body 104 is the twelfths fret. The region of the fretboard 112 between the location 118 and the proximal end of the fretboard 112 adjacent the twentieth fret 116 is a "tail" portion 120. The tail portion 120 is glued to a front surface 122 of the body 104. The neck 102 ends before the tail portion 120 and therefore does not provide support to the tail portion 120.

The fretboard 112 is usually made of a stiff material such as plastic or wood, and becomes warped or disfigured either at the time of manufacture or over time. FIG. 2 schematically illustrates an example of the disfigurement that the fretboard 112 and neck 103. Ideally, the fretboard 112 should be perfectly straight between the nut 114 and the twentieth fret 116, as shown in line 124. However, a bowed or scooped region 126 often appears between the nut 114 and the location 118 due to the tension of the strings, humidity, and/or some other factors The disfigurement causes the low spots in the middle of the scooped region 126 making the guitar difficult to play, or even making the guitar out-of-tune. Because the tail portion 120 of the fretboard 112 is supported by a neck support 130 and will not bend, the fretboard 112 may form a crease 128 near the location 118 due to the tension of the strings, humidity, and/or some other factors. The crease 128 may cause the higher frets in the tail portion 120, such as the $17^{th}$, $18^{th}$, $19^{th}$ and $20^{th}$ fret, to come in contact with the strings when lower frets are played.

Therefore, there is a need for improved neck support in a guitar.

SUMMARY

The present disclosure generally relates to a string instrument, more particularly, a guitar.

One embodiment provides a guitar. The guitar includes a guitar body including a guitar side, a neck support-fingerboard brace unit comprising a neck support and a fingerboard brace fixedly attached to each other, wherein the fingerboard brace has an elongated body with a brace surface and two ends, and the fingerboard brace is attached to the guitar side at the two ends, and a guitar top attached to the guitar side to form a sound box, wherein when assembled, the brace surface of the fingerboard brace is attached to an inner surface of the guitar top. The guitar further includes a guitar neck attached to the guitar body at the neck-support-fingerboard brace unit.

Another embodiment provides a method for making a guitar. The method includes forming a neck support-fingerboard brace unit having a neck support connected to a fingerboard brace, and then attaching a guitar top to the neck support-fingerboard brace unit.

Another embodiment provides a method for making a guitar. The method includes attaching a fingerboard brace to a guitar side, and then attaching a guitar top to the guitar side and the fingerboard brace to form a guitar body.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Embodiments of the present disclosure relates to a string instrument, such as a guitar, having a neck support-fingerboard brace unit. The neck support-fingerboard brace unit is formed as a unitary unit or formed by fixedly attaching a neck support to a fingerboard brace before attaching the fingerboard brace to a guitar top. The solid connection between the neck support and the fingerboard brace allows the fingerboard brace, which rests on a guitar side, to provide support to the guitar neck, thus, reducing deformation in the guitar neck and the fret board.

Figure 1:
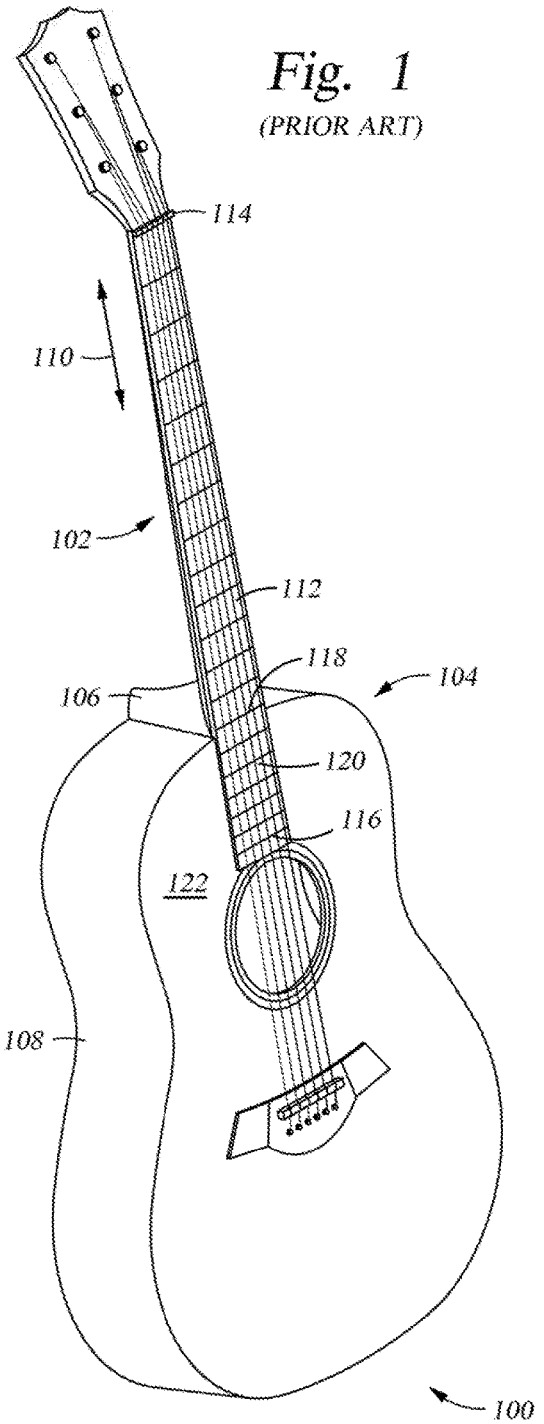
Fig. 1 (PRIOR ART)
FIG. 1 is a schematic exploded view of a prior art guitar.
Figure 2:
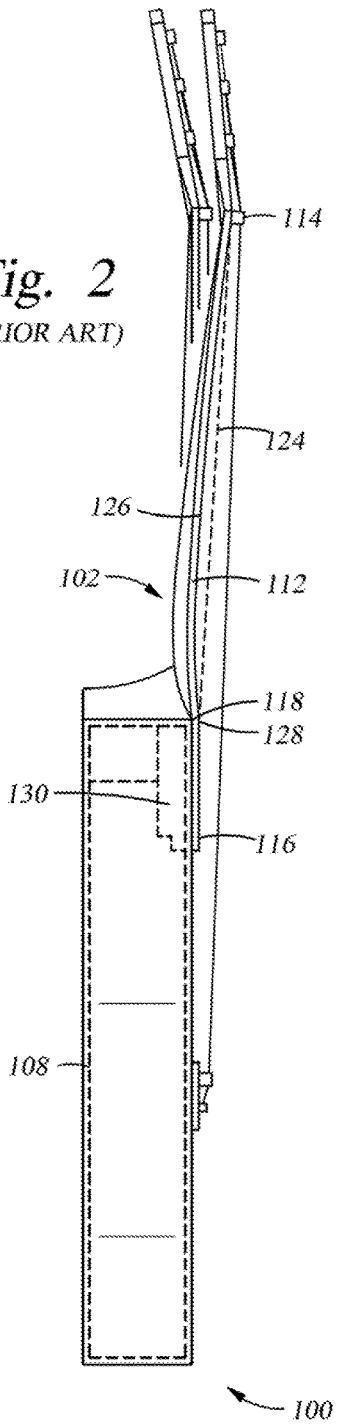
Fig. 2 (PRIOR ART)
FIG. 2 schematically illustrates a disfigurement that occurs to the prior art guitar.
Figure 3A:
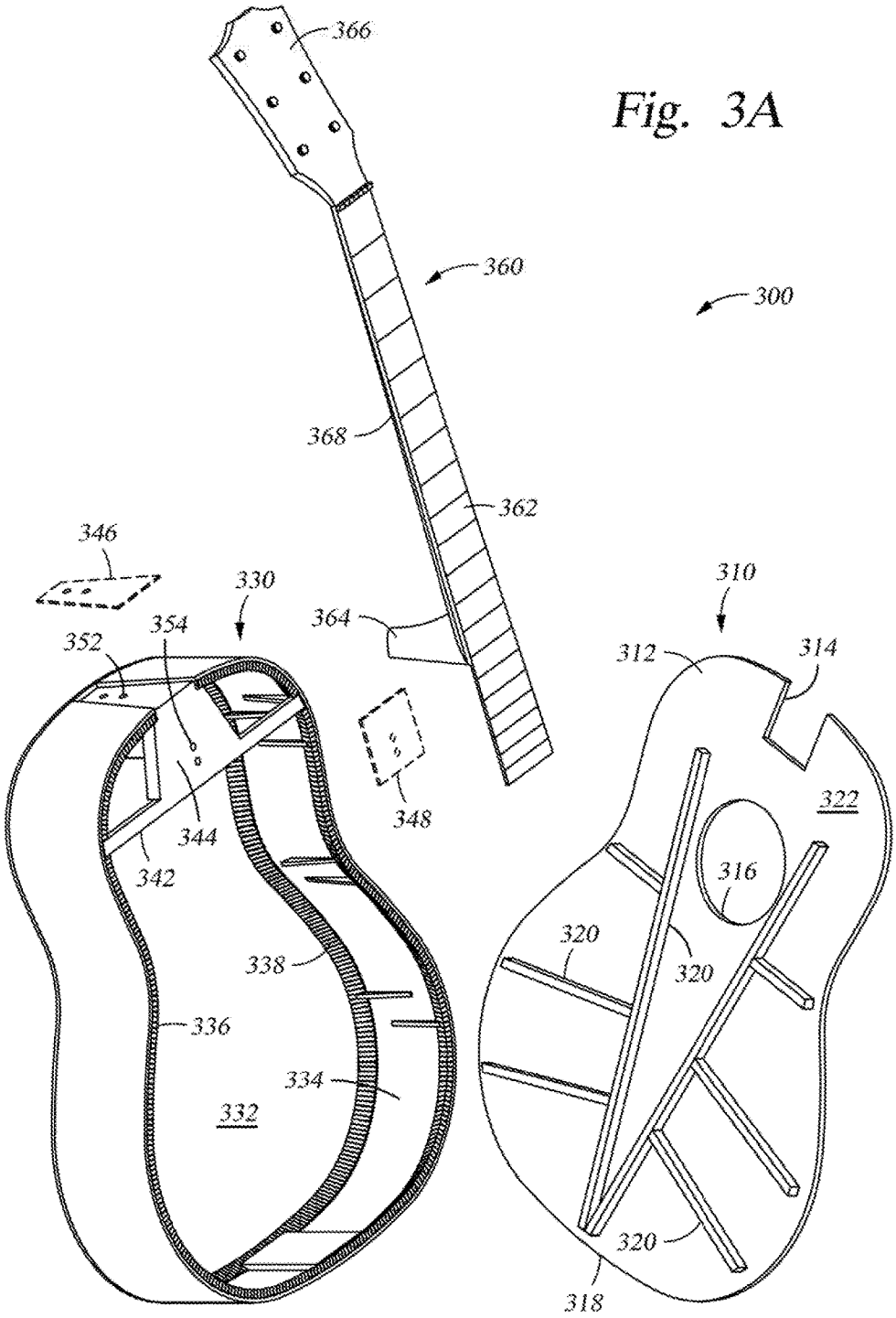
FIG. 3A is a schematic exploded view of a guitar according to one embodiment of the present disclosure.

FIG. 3A is a schematic exploded view of a guitar 300 according to one embodiment of the present disclosure. The guitar 300 includes a guitar top portion 310, a guitar body portion 330, and a guitar neck portion 360.

The neck portion 360 includes a neck blank 368 supporting a fretboard 362. The neck blank 368 may be made of a single piece of wood, metal, plastic, or other rigid material. Alternatively, the neck blank 368 may include two or three pieces of wood. The fretboard 362 may be made of wood, metal, plastic, or other rigid material that can be planed to a smooth flat surface. The neck portion 360 may also include a heel 364. When assembled, the heel 364 mates against the guitar body portion 330. A peg head 366 may be attached to the neck blank 368.

The guitar top portion 310 includes a top board 322. The top board 322 has a neck end 312 facing the guitar neck portion 360 when assembled and a heel portion 318 facing away from the neck end 312. The top board 322 has a sound port 316. A neck notch 314 may be formed at the neck end 312 to receive the guitar neck portion 360. A plurality of braces 320 may be attached to an inner surface of the top board 322. The braces 320 are strategically positioned to provide structural support to the top board 322. The braces 320 may be arranged in various arrangements to achieve a target sound effect. The braces 320 are attached to the top board 322 prior to attaching the guitar top portion 310 to the guitar body portion 330. Typically, a fingerboard brace is positioned across the top board 312 between the sound port 316 and the neck notch 314. According to embodiments of the present disclosure, a fingerboard brace is first attached to a neck support prior to attaching to the top board 312.

The guitar body portion 330 includes a bottom board 332 and a guitar side 334. The bottom board 332 may be joined to the guitar side 334 by adhesive. A plurality of lower liner supports 338 may be placed along a lower edge of the guitar side 334 to reinforce the attachment between the bottom board 332 and the guitar side 334. A plurality of upper liner supports 336 may be disposed along an upper edge of the guitar side 334 to reinforce the attachment between the guitar top portion 310 and the guitar body portion 330.

A neck support-fingerboard brace unit 340 is disposed inside the guitar body portion 330. The neck support-fingerboard brace unit 340 includes a fingerboard brace 342 and a neck support 344. The fingerboard brace 342 is fixedly attached to the neck support 344 or formed unitarily with the neck support 344. The fingerboard brace 342 reaches across the guitar body portion 330 and rests support structures on the guitar side 334, such as the upper liner supports 336. The fixed connection between the neck support 344 and the fingerboard brace 342 allows the guitar side 334 to provide structural support to the neck portion 360 attached to the neck support 344 when assembled.

Figure 3B:
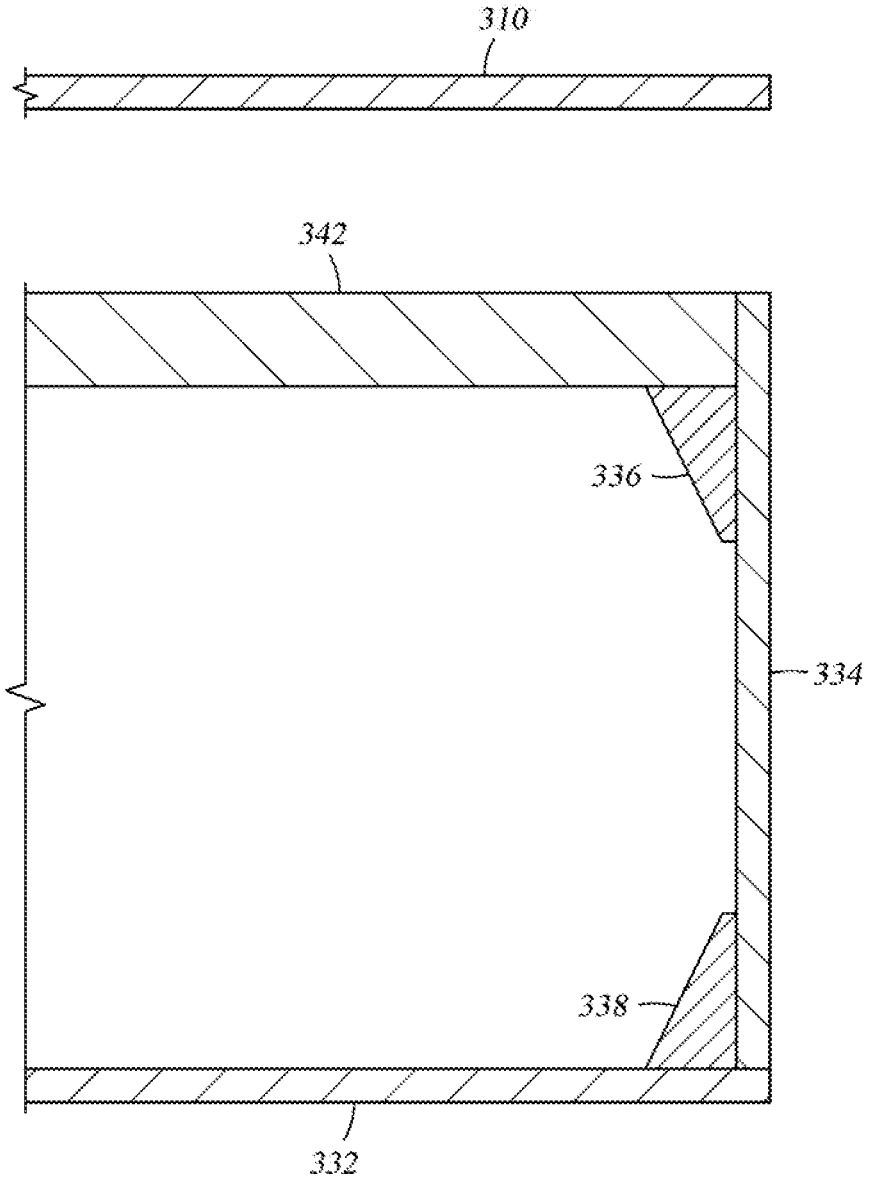
FIG. 3B is a partial sectional side view of the guitar of FIG. 3A showing a fingerboard brace attached to a guitar side prior to attaching a guitar top to the guitar side.

FIG. 3B is a partial sectional side view of the guitar 300 showing the fingerboard brace 342 attached to the guitar side 334. An end of the fingerboard brace 342 rests on a top surface of an upper liner support 336. In one embodiment, the end of the fingerboard brace 342 and the top surface of the upper liner support 336 may be joined together by glue. A side surface of the upper liner support 336 is glued to the guitar side 334. As a result, the upper liner support 336 provides an upward support to the fingerboard brace 342. The guitar top portion 310 is attached to the fingerboard brace 342 after the fingerboard brace 342 is attached to the guitar side 334.

Figure 3C:
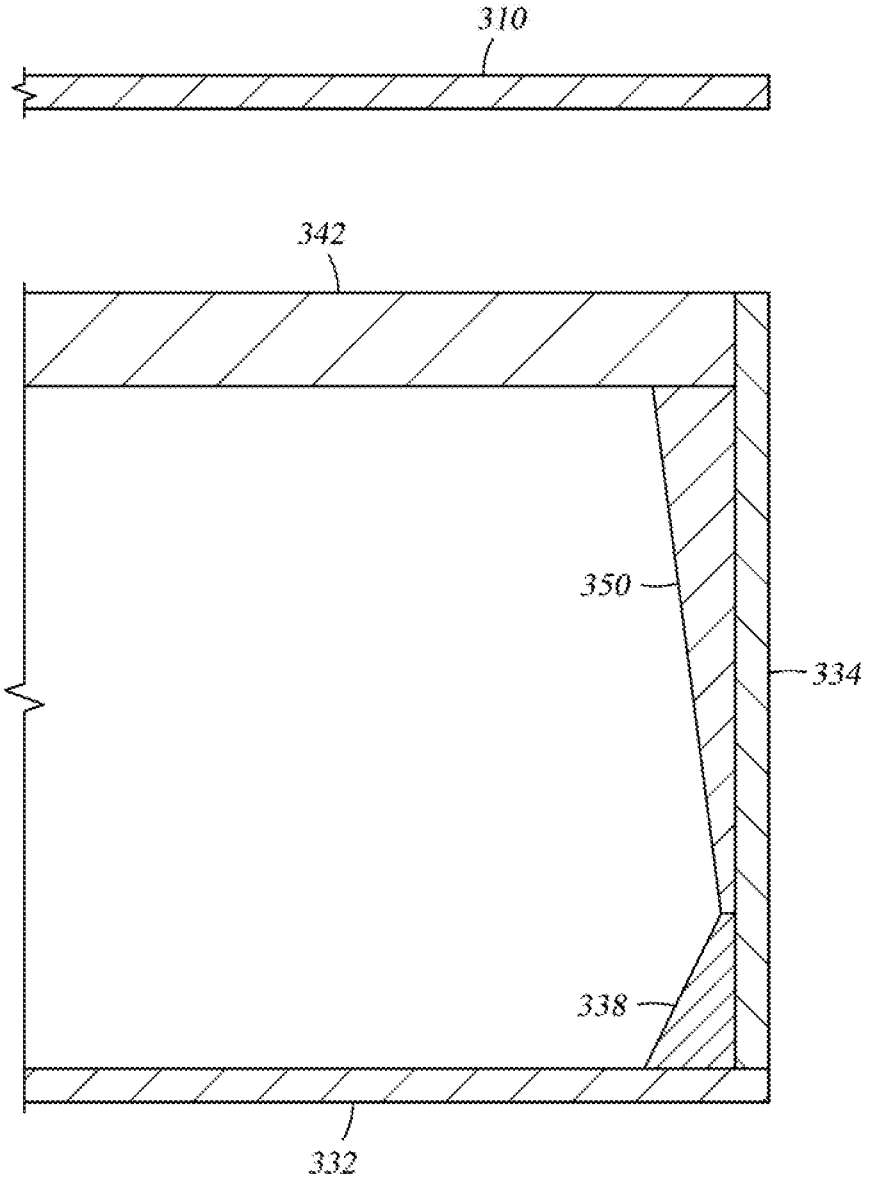
FIG. 3C is a partial sectional side view showing a fingerboard brace attached to a guitar side according to another embodiment.

FIG. 3C is a partial sectional side view of the guitar 300 showing the fingerboard brace 342 attached to the guitar side 334 according to another embodiment. A support finger 350 may replace the upper liner support 336 to provide additional support to the fingerboard brace 342. The support finger 350 may be an elongated wooden piece attached to the guitar side 334. An end of the fingerboard brace 342 rests on a top surface of the support finger 350. In one embodiment, the top surface of the support finger 350 and the end of the fingerboard brace 342 may be joined together by glue. The support finger 350 extends along a height of the guitar side 334 till the guitar bottom 332 or the lower liner support 338.

To assemble the guitar 300, the neck support-fingerboard brace unit 340 may be formed first and attached to the guitar side 334. In one embodiment, the neck support-fingerboard brace unit 340 manufactured from one piece of the wood. The unitary neck support-fingerboard brace unit 340 is then attached to the guitar side 334 before or after the guitar bottom 332 is attached to the guitar side 334.

In another embodiment, the neck support-fingerboard brace unit 340 may be formed from two or more pieces of wood. For example, the neck support 344 may formed from a denser hard wood while the fingerboard brace 342 may be formed from a lighter soft wood. The neck support 344 and the fingerboard brace 342 are then fixedly joined together, for example by adhesive or fasteners. In one embodiment, the fingerboard brace 342 may be attached to the neck support 344 first to form the neck support-fingerboard brace unit 340, and the formed unit is then attached to the guitar body portion 330. In another embodiment, the neck support 344 may be attached to the guitar body portion 330 first, and the fingerboard brace 342 may be attached to the neck support 344.

After the neck support-fingerboard brace unit 340 is attached to the guitar body portion 330, adhesive may be applied to a top surface of the neck support-fingerboard brace unit 340 and the upper liner supports 336 to join the guitar top portion 310 and the guitar body portion 330.

The neck portion 360 may be attached to the guitar body portion 330 prior or after the guitar top portion 310 is attached to the guitar body portion 330. The neck portion 360 may be attached to the guitar body portion 310 by fasteners, adhesive, or a combination thereof. As shown in FIG. 3A, the neck portion 360 is attached to the guitar body portion 330 by a plurality of bolts. In FIG. 3A, four bolt holes are shown. Two bolt holes 352 formed through the neck support 344 towards the guitar side 344 to connect with the heel 364. Two bolt holes 354 formed through the neck support 344 towards the guitar top portion 310 to connect with the neck blank 368. In one embodiment, optional spacers 346, 348 may be used between the guitar neck portion 360 and the guitar body portion 330 to ensure a desired alignment.

Figure 4A:
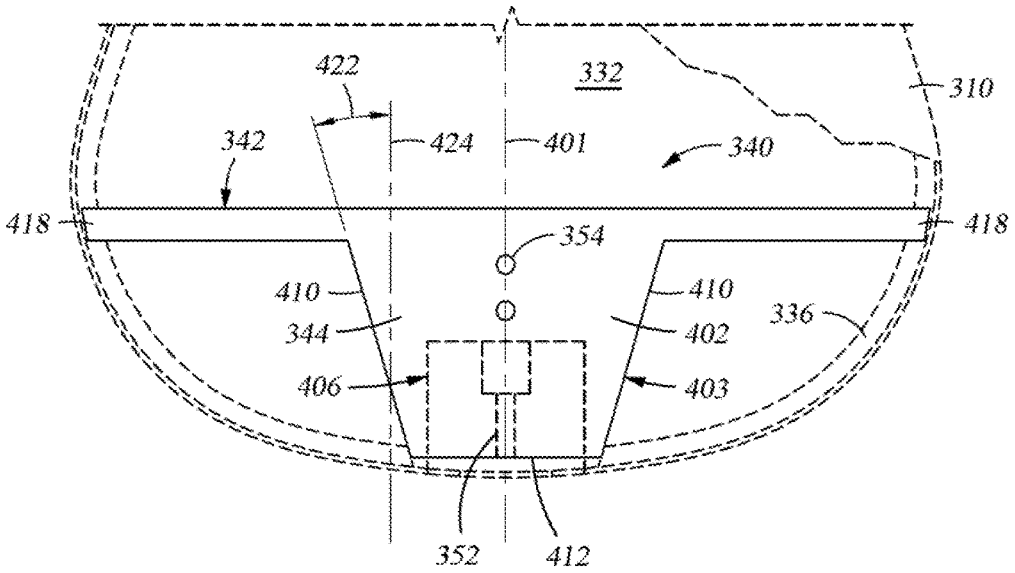
FIG. 4A is a schematic top view of a neck support-fingerboard brace unit according to one embodiment of the present disclosure.
Figure 4B:
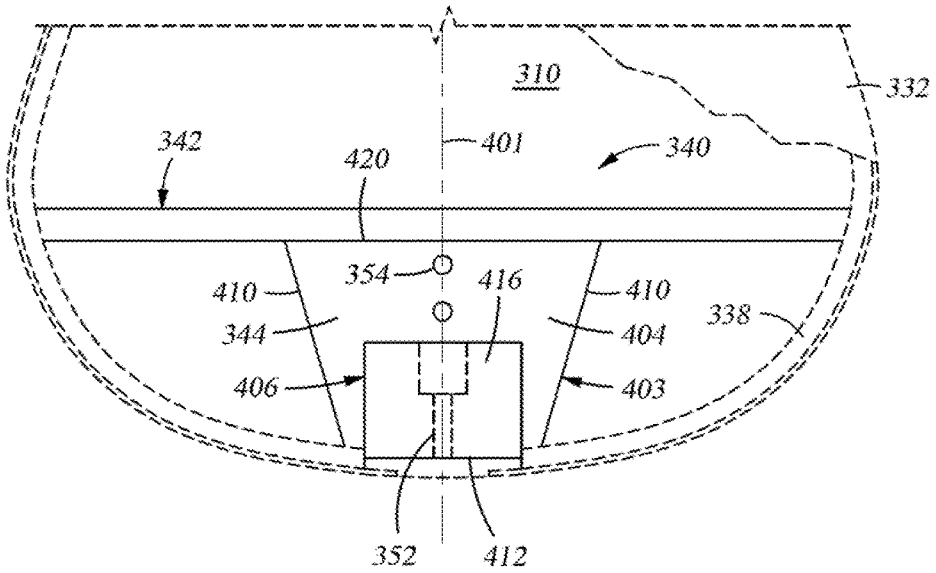
FIG. 4B is a schematic bottom view of the neck support-fingerboard brace unit of FIG. 4A.
Figure 4C:
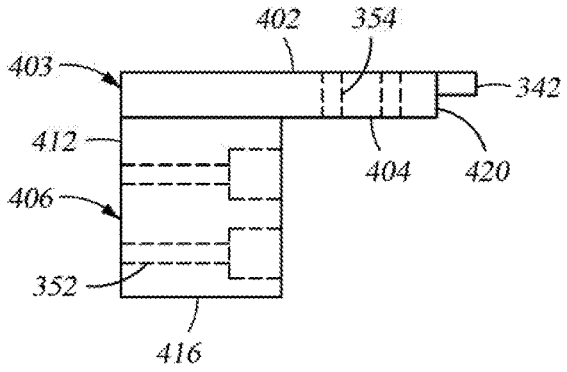
FIG. 4C is a schematic side view of the neck support-fingerboard brace unit of FIG. 4A.
Figure 4D:
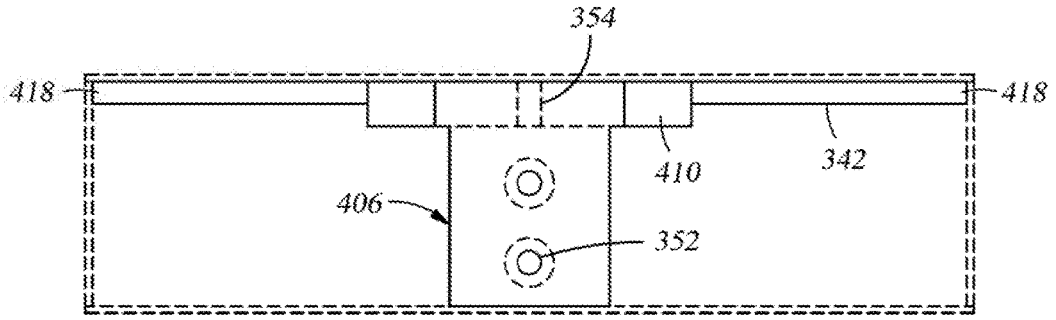
FIG. 4D is a schematic side view of the neck support-fingerboard brace unit of FIG. 4A.

FIGS. 4A-4D illustrates the neck support-fingerboard brace unit 340 according to one embodiment of the disclosure. FIG. 4A is a schematic top view of the neck support-fingerboard brace unit 340. FIG. 4B is a schematic bottom view of the neck support-fingerboard brace unit 340. FIG. 4C is a schematic side view of the neck support-fingerboard brace unit 340. FIG. 4D is another schematic side view of the neck support-fingerboard brace unit 340.

The neck support-fingerboard brace unit 340 may include an upper portion 403 and a lower portion 406. The fingerboard brace 342 is attached to or extended from a front surface 420 of the top portion 403. Ends 418 of the fingerboard brace 342 are configured to attach to the guitar side. The top portion 403 and the fingerboard brace 342 form a substantially planar top surface 402. The top surface 402 may be attached to the guitar top.

The upper portion 403 may be a planar plate having angled sides 410 that is formed at an angle 422 relative to a central axis 401. In one embodiment, the upper portion 403 may have a shape of a trapezoid. Because a guitar top is typically made of a thin wood panel having wood grains in a direction 424 parallel to the central axis 401. The angled sides 410 intersect with the wood grains of the guitar top thus avoiding splitting the guitar top along the wood grain. In one embodiment, the angel 422 is between about 10 degrees to about 45 degrees.

Figure 4E:
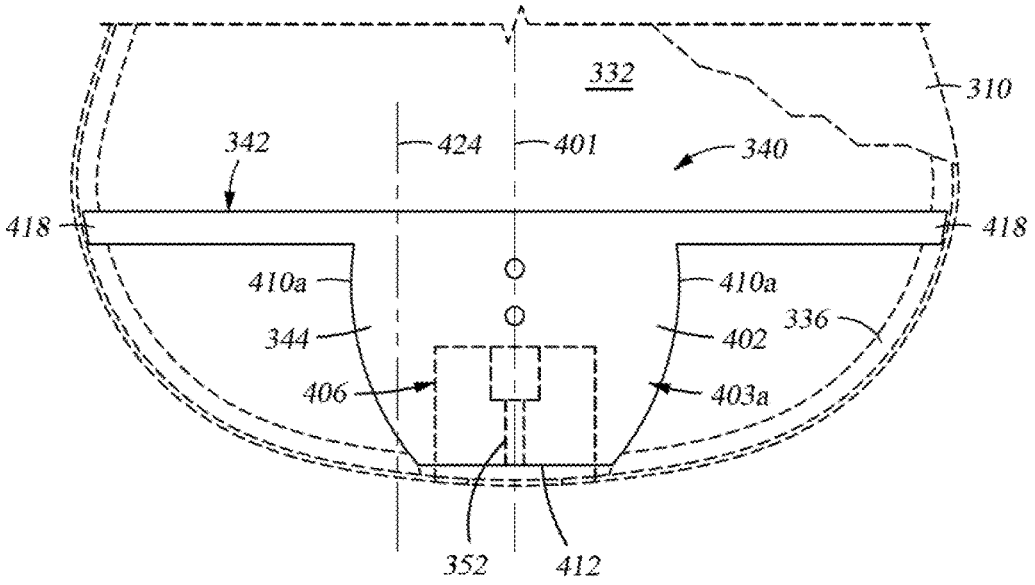
FIGS. 4E-4H are schematic top views of a neck support-fingerboard brace unit having sides of different shapes.
Figure 4F:
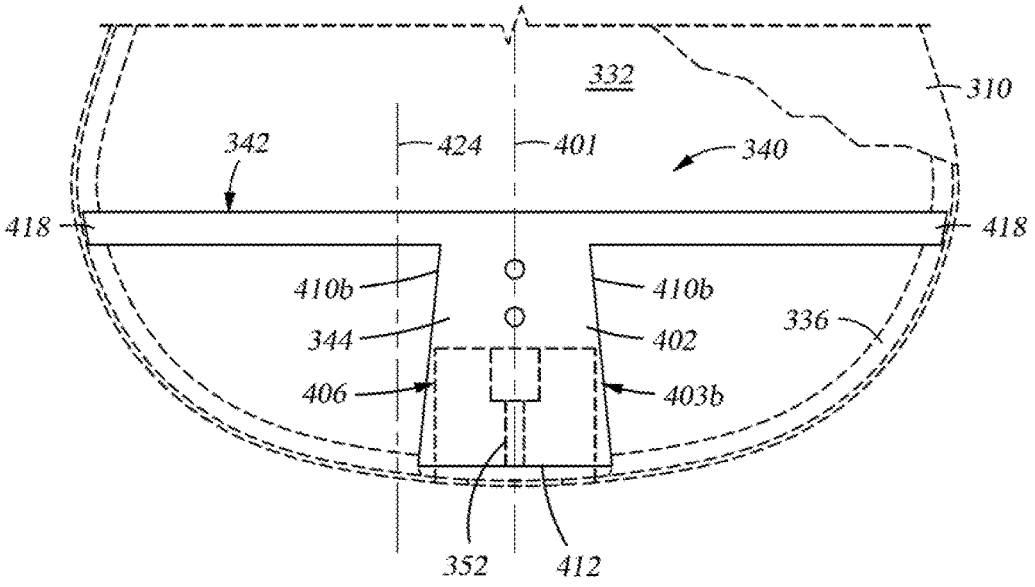
Figure 4G:
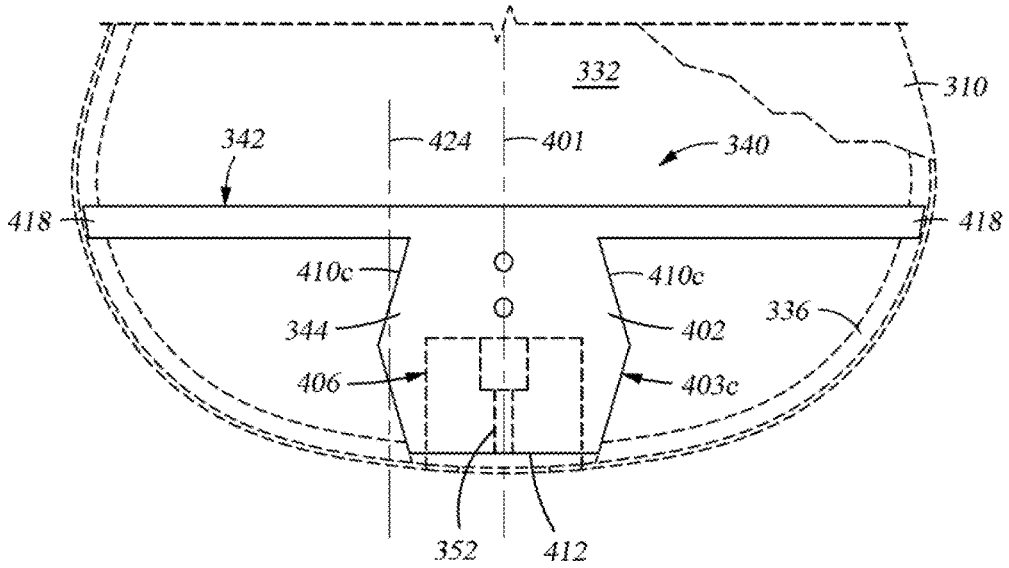
Figure 4H:
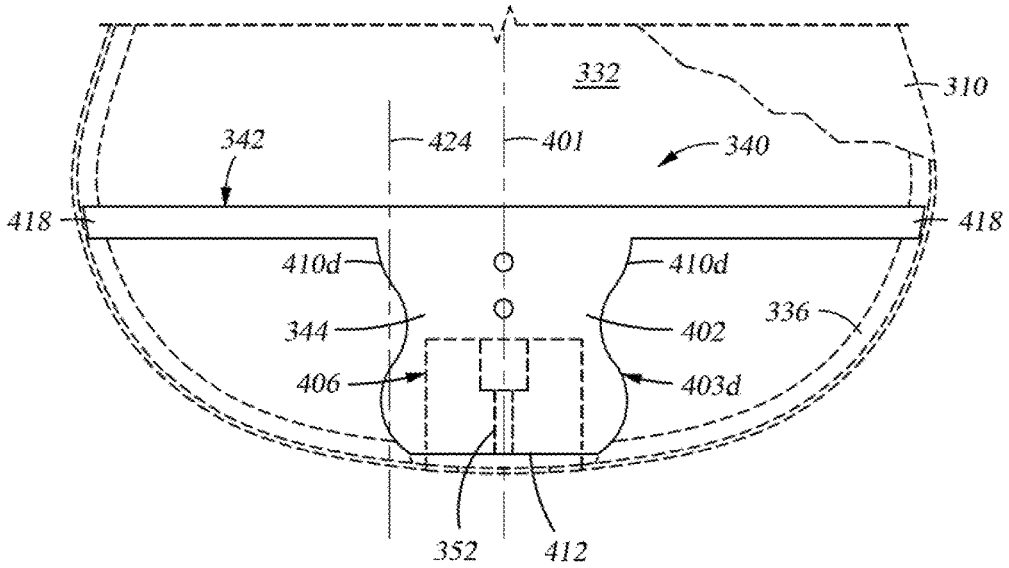

Alternately, the sides 410 of the upper portion 403 could be any shape that allows the edges of the top portion 403 to intersect the wood grains. FIGS. 4E-4H schematically illustrate a few examples of sides of other shapes. For example, the sides may be a curve 410*a* intersecting the wood grain direction 424 as shown in FIG. 4E, a reversed straight line 410*b* intersecting the wood grain direction 424 as shown in FIG. 4F, a combined angled lines 410*c* intersecting the wood grain direction 424 as shown in FIG. 4G, or a wave 410*d* intersecting with the wood grain direction 424 as shown in FIG. 4H. Additionally, the two sides 410 may have different shapes.

The lower portion 406 extends from a lower surface 404 of the top portion 403. A bottom surface 416 of the lower portion 406 is configured to be in contact with the guitar bottom when assembled. The bottom surface 416 is smaller in area than the top surface 402. The bottom portion 406 has a heel surface 412 configured to connect to the heel of the neck portion.

One or more bolt holes 354 are formed through the top portion 403 to connect with a back side of the neck portion. One or more bolt holes 352 are formed through the lower portion 406 to connect with a heel of the neck portion.

The fingerboard brace 342, the upper portion 403, and the lower portion 406 may be made from one piece of wood. Alternatively, the fingerboard brace 342, the upper portion 403, and the lower portion 406 may be formed from two or more pieces of wood and joined together to form a unit.

Figure 5A:
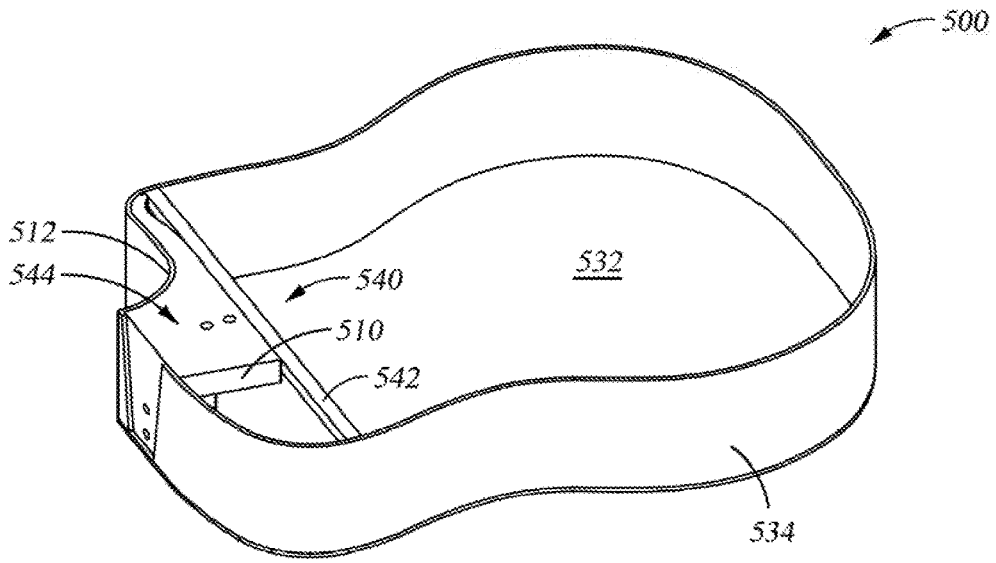
FIG. 5A is a partial perspective view of a guitar with a top removed showing a neck support-fingerboard brace unit according to another embodiment of the present disclosure.
Figure 5B:
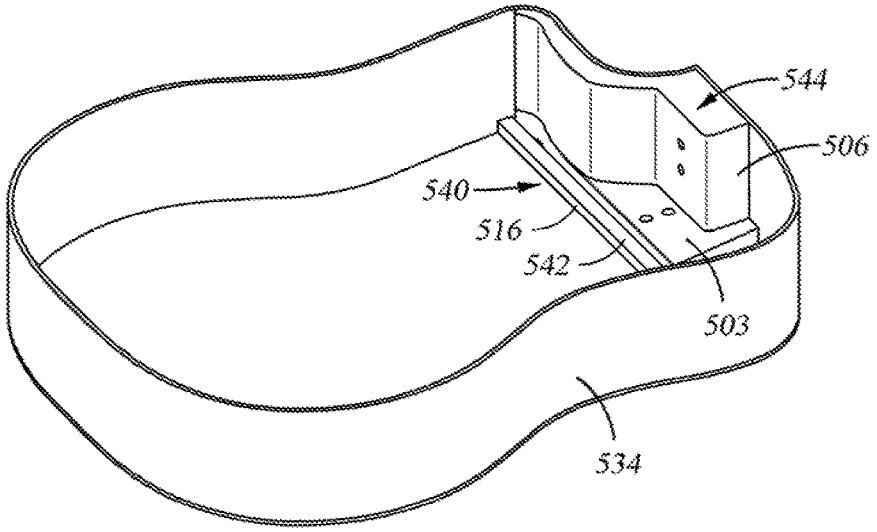
FIG. 5B is a partial perspective view of a guitar with a bottom removed showing the neck support-fingerboard brace unit FIG. 5A.

FIGS. 5A-5F schematically illustrates a neck support-fingerboard brace unit 540 according to another embodiment of the present disclosure. FIG. 5A is a partial perspective view of a guitar 500 with a top removed showing the neck support-fingerboard brace unit 540. FIG. 5B is a partial perspective view of the guitar 500 with a bottom removed showing the neck support-fingerboard brace unit 540. The guitar 500 is a guitar with a cut-out body style. The neck support-fingerboard brace unit 540 is similar to the neck support-fingerboard brace unit 340 except having a curved side conforming to a cut away body style.

Figure 5C:
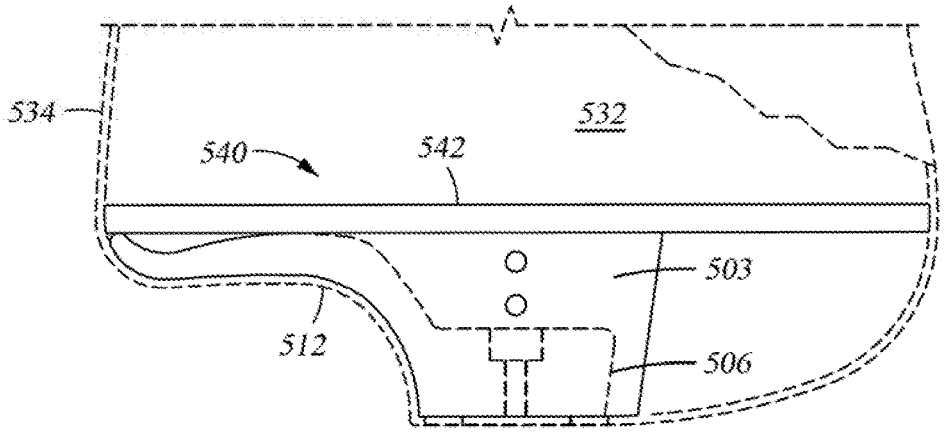
FIG. 5C is a schematic top view of the neck support-fingerboard brace unit FIG. 5A.
Figure 5D:
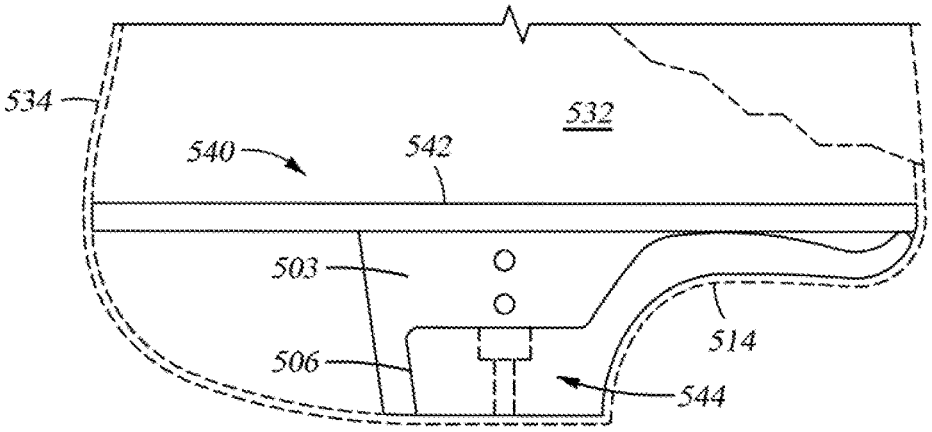
FIG. 5D is a schematic bottom view of the neck support-fingerboard brace unit FIG. 5A.
Figure 5E:
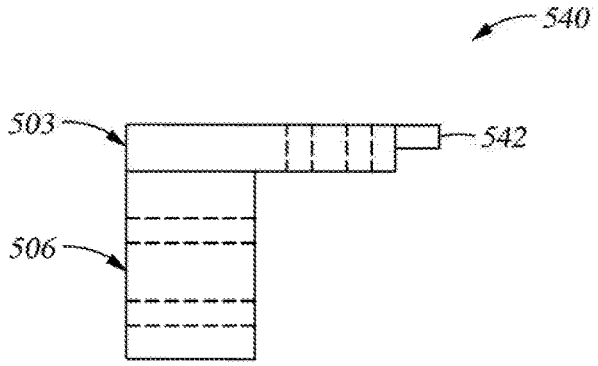
FIG. 5E is a schematic side view of the neck support-fingerboard brace unit of FIG. 5A.
Figure 5F:
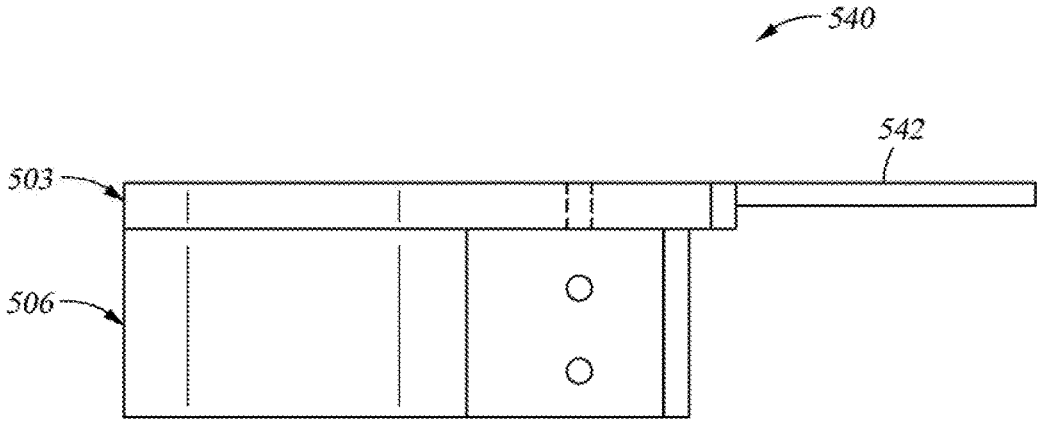
FIG. 5F is a schematic side view of the neck support-fingerboard brace unit of FIG. 5A.

FIG. 5C is schematic top view of the neck support-fingerboard brace unit 540. FIG. 5D is schematic bottom view of the neck support-fingerboard brace unit 540. FIG. 5E is a schematic side view of the neck support-fingerboard brace unit 540. FIG. 5F is another schematic side view of the neck support-fingerboard brace unit 540.

The neck support-fingerboard brace unit 540 includes an upper portion 503, a lower portion 506, and a fingerboard brace 542. The fingerboard brace 542 is attached to or extended from a front surface 518 of the upper portion 503. Ends 518 of the fingerboard brace 542 are configured to attach to the guitar side. The upper portion 503 and the fingerboard brace 542 form a substantially planar top surface 502. The top surface 502 may be attached to the guitar top.

The upper portion 503 may be a planar plate having one angled side 510 and one curved side 512. The angled side 510 may intersect with the wood grains of the guitar top thus avoiding splitting the guitar top along the wood grain. Similar to the side 410, the side 510 may be any suitable shape that intersects the wood grain direction of the guitar top. The curved side 512 is shaped to form a cut away.

The lower portion 506 extends from a lower surface 504 of the upper portion 503. A bottom surface 516 of the lower portion 506 is configured to be in contact with the guitar bottom when assembled. The bottom portion 506 may also have a curved side 514 to provide additional support to the cut away in the guitar body.

The fingerboard brace 542, the upper portion 503, and the lower portion 506 may be made from one piece of wood. Alternatively, the fingerboard brace 542, the upper portion 503, and the lower portion 506 may be formed from two or more pieces of wood and joined together to form a unit.

According to embodiments of the present disclosure, the fingerboard brace is either unitarily formed with the neck support or fixedly attached to the neck support. The fingerboard brace is attached to the guitar side first and then attached to the guitar front. Because the ends of the fingerboard brace are attached to the guitar side, the guitar sides provide structural support to the guitar neck through the fingerboard brace. As a result, the guitar neck is less likely to bowl or form a crease due to the tension of the strings, humidity, and/or some other factors.

Embodiments of the present disclosure provide a guitar including a guitar body and a guitar neck. The guitar body includes a guitar side, a neck support-fingerboard brace unit comprising a neck support and a fingerboard brace fixedly attached to each other, wherein the fingerboard brace has an elongated body with a brace surface and two ends, and the fingerboard brace is attached to the guitar side at the two ends, and a guitar top attached to the guitar side to form a sound box, wherein when assembled, the brace surface of the fingerboard brace is attached to an inner surface of the guitar top. The guitar neck is attached to the guitar body at the neck-support-fingerboard brace unit.

In one or more embodiment, the neck support and the fingerboard brace are formed as a unitary body.

In one or more embodiment, a side surface of the fingerboard brace is attached to a front surface of the fingerboard brace.

In one or more embodiment, the fingerboard brace is glued to the neck support.

In one or more embodiment, the neck support includes a top portion having a top surface, a front surface and two sides, wherein the fingerboard brace extends from the front surface, and the guitar top is attached to the front surface when assemble, and a bottom portion having a bottom surface for attaching to a guitar back.

In one or more embodiment, each side of the top portion is formed at an angle relative to a longitudinal axis of the guitar body.

In one or more embodiment, the guitar top has a neck notch, when assembled, the guitar neck is attached to the neck support at a portion of the top surface of the neck support exposed by the neck notch.

In one or more embodiment, the guitar further includes a top spacer disposed between the guitar neck and the top surface of the neck support.

In one or more embodiment, the neck support has a heel surface, and a heel of the guitar neck is attached to the heel surface.

In one or more embodiment, the guitar further includes a heel spacer disposed between the heel of the guitar neck and the heel surface.

Another embodiment provides a method for making a guitar including forming a neck support-fingerboard brace unit having a neck support connected to a fingerboard brace, and then attaching a guitar top to the neck support-fingerboard brace unit.

In one or more embodiment, the method further includes, prior to attaching the guitar top of the neck support-fingerboard brace unit, attaching the fingerboard brace unit to a guitar side.

In one or more embodiment, forming a neck support-fingerboard brace unit includes forming a unitary body having the neck support and the fingerboard brace.

In one or more embodiment, forming a neck support-fingerboard brace unit includes fixedly attaching the fingerboard brace to the neck support.

In one or more embodiment, the method includes attaching the fingerboard brace to the neck support prior to attaching the fingerboard brace to the guitar side.

In one or more embodiment, the method further includes attaching the neck support to the guitar side, and attaching the fingerboard brace simultaneously to the guitar side and the neck support.

In one or more embodiment, attaching the fingerboard brace to the guitar side includes attaching two ends of the fingerboard brace to the guitar side.

In one or more embodiment, attaching the fingerboard brace to the guitar side includes attaching two ends of the fingerboard brace to two liner supports attached to the guitar side.

Another embodiment of the present disclosure provides a method for making a guitar including attaching a fingerboard brace to a guitar side, and then attaching a guitar top to the guitar side and the fingerboard brace to form a guitar body.

In one or more embodiment, the method further includes forming a neck support-fingerboard brace unit having a neck support connected to the fingerboard brace.

While the foregoing is directed to embodiments of the present disclosure, other and further embodiments of the disclosure may be devised without departing from the basic scope thereof, and the scope thereof is determined by the claims that follow.

The invention claimed is:

1. A guitar, comprising:

a guitar body, comprising:

a guitar side;

a neck support-fingerboard brace unit comprising a neck support and a fingerboard brace fixedly attached to each other, wherein the fingerboard brace has an elongated body with a brace surface and two ends, and the fingerboard brace is attached to the guitar side at the two ends, and the neck support comprises:

a top portion having a top surface, a front surface and two sides, wherein the fingerboard brace extends from the front surface, and a guitar top is attached to the top surface when assembled, each side of the top portion is formed at an angle relative to a longitudinal axis of the guitar body; and a bottom portion having a bottom surface for attaching to a guitar back; and the guitar top attached to the guitar side to form a sound box, wherein when assembled, the brace surface of the fingerboard brace is attached to an inner surface of the guitar top; and a guitar neck attached to the guitar body at the neck-support-fingerboard brace unit.

2. The guitar of claim 1, wherein the neck support and the fingerboard brace are formed as a unitary body.

3. The guitar of claim 1, wherein a side surface of the fingerboard brace is attached to the front surface of the neck support.

4. The guitar of claim 3, wherein the fingerboard brace is glued to the neck support.

5. The guitar of claim 1, wherein the guitar top has a neck notch, when assembled, the guitar neck is attached to the neck support at a portion of the top surface of the neck support exposed by the neck notch.

6. The guitar of claim 5, further comprising a top spacer disposed between the guitar neck and the top surface of the neck support.

7. The guitar of claim 1, wherein the neck support has a heel surface, and a heel of the guitar neck is attached to the heel surface.

8. The guitar of claim 7, further comprising a heel spacer disposed between the heel of the guitar neck and the heel surface.

9. A method for making a guitar, comprising:

forming a neck support-fingerboard brace unit having a neck support connected to a fingerboard brace, wherein the fingerboard brace has an elongated body with a brace surface and two ends;

attaching the fingerboard brace unit to a guitar side; and then attaching a guitar top to the neck support-fingerboard brace unit, wherein upon attaching the guitar top, the brace surface of the fingerboard brace is attached to an inner surface of the guitar top.

10. The method of claim 9, wherein forming a neck support-fingerboard brace unit comprises forming a unitary body having the neck support and the fingerboard brace.

11. The method of claim 9, wherein forming a neck support-fingerboard brace unit comprises fixedly attaching the fingerboard brace to the neck support.

12. The method of claim 11, wherein attaching the fingerboard brace to the neck support prior to attaching the fingerboard brace to the guitar side.

13. The method of claim 11, further comprising attaching the neck support to the guitar side, and attaching the fingerboard brace simultaneously to the guitar side and the neck support.

14. The method of claim 9, wherein attaching the fingerboard brace to the guitar side comprises attaching two ends of the fingerboard brace to the guitar side.

15. The method of claim 14, wherein attaching the fingerboard brace to the guitar side comprises:

attaching two ends of the fingerboard brace to two liner supports attached to the guitar side.

16. A method for making a guitar, comprising:

attaching a fingerboard brace to a guitar side, wherein the fingerboard brace has an elongated body with a brace surface and two ends, and the fingerboard brace is attached to the guitar side at the two ends; and then attaching a guitar top to the guitar side with the fingerboard brace to form a guitar body, wherein upon attaching the guitar top, the brace surface of the fingerboard brace is attached to an inner surface of the guitar top.

17. The method of claim 16, further comprising:

forming a neck support-fingerboard brace unit having a neck support connected to the fingerboard brace.

18. The guitar of claim 1, further comprising two liner supports attached to the guitar side, each liner support has a side surface and a top surface, the side surface of the liner support is attached to the guitar side, and each of the two ends of the fingerboard brace is attached to the top surface of the liner support.

19. The method of claim 9, wherein attaching the guitar top to the neck support-fingerboard brace unit comprises attaching sides of the neck support to the guitar top at an angle relative to a central axis of the guitar body.

20. The method of claim 9, wherein the neck support has a top surface, a front surface and two sides, and attaching the guitar top to the neck support-fingerboard brace unit comprises attaching each side to the guitar top at an angle relative to a longitudinal axis of the guitar body.

21. The method of claim 16, wherein upon attaching the guitar top, each side of the neck support is at an angle relative to a central axis of the guitar body.

* * * * *